US005431836A

United States Patent [19]

Carr et al.

[11] Patent Number: 5,431,836

[45] Date of Patent: Jul. 11, 1995

[54] CARBONATE BUILT LAUNDRY DETERGENT COMPOSITION

[75] Inventors: Charles D. Carr, Yardley, Pa.; Joseph G. Becker, Martinsville, N.J.; Anthony J. Falotico, Doylestown, Pa.; Steven A. Bolkan, Hopewell, N.J.

[73] Assignee: Church & Dwight Co., Inc., Princeton, N.J.

[21] Appl. No.: 136,394

[22] Filed: Oct. 13, 1993

[51] Int. Cl.[6] ..... C11D 3/10; C11D 3/37; C11D 1/722

[52] U.S. Cl. ..... 252/174.14; 252/174.21; 252/174.23; 252/174.24; 134/42

[58] Field of Search ..... 252/174.14, 174.23, 252/174.24, 174.21; 134/42

[56] References Cited

U.S. PATENT DOCUMENTS

| | | | |
|---|---|---|---|
| 4,265,790 | 5/1981 | Winston et al. | 252/532 |
| 4,430,243 | 7/1984 | Bragg | 252/91 |
| 4,464,292 | 8/1984 | Lengyel | 252/532 |
| 4,490,271 | 12/1984 | Spadini et al. | 252/174.23 |
| 4,521,332 | 6/1985 | Milora | 252/527 |
| 4,711,740 | 12/1987 | Carter et al. | 252/174.24 |
| 4,785,060 | 11/1988 | Nagler et al. | 525/444 |
| 4,820,441 | 4/1989 | Evans et al. | 252/174.18 |
| 4,849,125 | 7/1989 | Seiter et al. | 252/109 |
| 4,853,259 | 8/1989 | Taha | 427/221 |
| 4,908,039 | 3/1990 | Holland | 8/137 |
| 4,983,315 | 1/1991 | Glogowski | 252/102 |
| 4,999,128 | 3/1991 | Sonenstein | 252/174.14 |
| 5,026,400 | 6/1991 | Holland | 8/137 |
| 5,152,910 | 10/1992 | Savio et al. | 252/95 |
| 5,152,911 | 10/1992 | Savio et al. | 252/95 |
| 5,268,119 | 12/1993 | Simpson et al. | 252/95 |

OTHER PUBLICATIONS

M. M. Reddy et al., "Crystallization of Calcium Carbonate in the Presence of Metal Ions," Journal of Crystal Growth 50 (1980) 470–480.

*Primary Examiner*—Paul Lieberman
*Assistant Examiner*—Kery Fries
*Attorney, Agent, or Firm*—Charles B. Barris

[57] ABSTRACT

A laundry detergent composition, wherein the solids content comprises an active surfactant, at least about 70 wt. % of a water soluble alkaline carbonate, e.g., sodium carbonate, up to about 12 wt. % of elemental magnesium in the form of a water soluble salt, e.g., magnesium sulfate or magnesium chloride, and about 0.05 to 5 wt. % of a polymeric polycarboxylate, e.g., an acrylic acid polymer, based on the total weight of solids in the composition. Incorporation of magnesium ions in the foregoing laundry detergent composition containing carbonate ions is intended to minimize negative interactions that will occur between the precipitation of calcium carbonate and the surfaces of the fabric being cleaned, e.g., fabric encrustation, with an enhancement of this effect due to the presence of the polymeric polycarboxylate.

17 Claims, No Drawings

CARBONATE BUILT LAUNDRY DETERGENT COMPOSITION

BACKGROUND OF THE INVENTION

Field of the invention

This invention relates to novel laundry detergent compositions having a high water-soluble alkaline carbonate builder content, the use of which results in reduced fabric encrustation.

Information Disclosure Statement Including Description of Related Art

The following information is being disclosed under the provisions of 37 CER 1.56, 1.97 and 1.98.

Laundry detergent compositions comprising a water-soluble alkaline carbonate are well-known in the art. For example, it is conventional to use such a carbonate as a builder in detergent compositions which supplement and enhance the cleaning effect of an active surfactant present in the composition. Such builders improve the cleaning power of the detergent composition, for instance, by the sequestration or precipitation of hardness causing metal ions such as calcium, peptization of soil agglomerates, reduction of the critical micelle concentration, and neutralization of acid soil, as well as by enhancing various properties of the active detergent, such as its stabilization of solid soil suspensions, solubilization of water-insoluble materials, emulsification of soil particles, and foaming and sudsing characteristics. Other mechanisms by which builders improve the cleaning power of detergent compositions are probably present but are less well understood. Builders are important not only for their effect in improving the cleaning ability of active surfactants in detergent compositions, but also because they allow for a reduction in the amount of the surfactant used in the composition, the surfactant being generally much more costly than the builder.

Two important classes of builders have been widely used in recent years, viz., phosphorus containing salts such as sodium tripolyphosphate (STPP) which are very effective in sequestering calcium and magnesium ions without precipitating them, and the water-soluble alkaline carbonates mentioned previously such as sodium carbonates which may be used in amounts up to 90 wt. % of the composition and which effectively precipitate the calcium ions. However, phosphorus-containing builders have been found to cause a serious problem of eutrophication of lakes, rivers and streams when present in detergent compositions in relatively large amounts, resulting in the passage of laws in several states mandating a drastic reduction in their use. While the use of water-soluble alkaline carbonate builders do not cause eutrophication, they result in the unrelated problem of calcium carbonate precipitation, leading to, for example, fabric encrustation due to the deposition of the calcium carbonate on the fiber surfaces of fabrics which in turn causes fabric to have a stiff hand and gives colored fabrics a faded appearance.

Polymeric polycarboxylates such as polyacrylates are also known in the detergent art as effective sequestering and dispersing agents as well as crystal growth inhibitors. However, such polycarboxylates have limited biodegradability which presents an environmental problem if they are used in relatively large amounts.

The following prior art references may be considered relevant or material to the invention claimed herein.

U.S. Pat. Nos. 4,265,790, issued May 5, 1981 to Winston et al., and 4,464,292, issued Aug. 7, 1984 to Lengyel, disclose detergent compositions comprising an ethoxylated alcohol and an ethoxy sulfate as a combination of nonionic and anionic surfactants, and over 70 wt % of anhydrous sodium carbonate (soda ash) as a detergent builder.

U.S. Pat. No. 4,490,271, issued Dec. 25, 1984 to Spadini et al., discloses detergent compositions comprising an active surfactant, up to 80% of a non-phosphorus detergent builder such as a water-soluble carbonate, and a polyacrylate such as a copolymer of acrylic acid with any of various comonomers.

U.S. Pat. No. 4,521,332, issued Jun. 4, 1985 to Milora, discloses highly alkaline liquid cleaning compositions comprising a nonionic surfactant, 10 to 45 wt. % of sodium hydroxide, 0.04 to 4 wt. % of a polyacrylic acid salt, 0 to 15 wt. % of an alkali metal phosphate builder such as STPP, 0.5 to 20 wt. % of a "building agent" such as sodium carbonate, and 6 to 60 wt. % of water.

U.S. Pat. No. 4,711,740, issued Dec. 8, 1987 to Carter et al., discloses detergent compositions comprising a "detergent active" compound, i.e., a surfactant, a detergent builder which is a water-soluble carbonate, e.g. sodium carbonate in an amount of "at least 5% by weight, such as from 10% to 40%, preferably 10% to 30% weight, though an amount up to 75% could possible be used if desired in special products," a water insoluble carbonate, e.g., calcium carbonate (calcite) in an amount of 5 to 60 wt. %, as seed crystals for precipitated calcium carbonate which is thus prevented from being deposited on fabrics; and a copolymer of a carboxylic monomer, e.g., acrylic acid, and a non-carboxylic monomer, such copolymer being present in an amount of 0.1 to 10 wt. % and acting as a colloid stabilizer for the precipitated calcium carbonate. Other detergency builders such as STPP may also be present.

U.S. Pat. No. 4,820,441, issued Apr. 11, 1989 to Evans et al., discloses granular detergent compositions which may contain in addition to an active surfactant, 5 to 75 wt. % of a crystal growth modified, carbonate-based structurant salt, 0.1 to 20 wt. % of a polymeric polycarboxylate as crystal growth modifier based on the weight of the structurant salt, and 0 to 40 wt. % of STPP. The structurant salt may contain sodium sulfate as well as sodium carbonate and sodium bicarbonate, and the two tables under the heading "PRODUCTS OF THE INVENTION" in columns 8 and 9 of the patent show a maximum of 40 wt. % of sodium carbonate in the final product composition.

U.S. Pat. No. 4,849,125, issued Jul. 18, 1989 to Seiter et al., discloses phosphate-reduced, granular, free-flowing detergent compositions comprising 4 to 40 wt. % of a nonionic surfactant, 3 to 20 wt. % of an anionic surfactant, 0.5 to 15 wt. % of a homopolymeric or copolymeric carboxylic acid or salt, 0 to 20 wt. % of STPP, and, optionally, up to 15 or 20 wt. % of sodium carbonate.

M. M. Reddy and K. K. Wang, "Crystallization of Calcium Carbonate in the Presence of Metal Ions" Journal of Crystal Growth 50 (1980) 470–480, discusses the influence of magnesium ions in solution on the growth of pure calcite from a stable supersaturated solution onto a well-characterized pure calcite surface.

Application Ser. No. 08/136,397, filed Oct. 13, 1993 by the applicants in this application, discloses and claims carbonate built cleaning compositions containing a minor amount of elemental magnesium in the form of a water soluble salt, but is not limited to laundry detergent compositions containing an active surfactant and a polymeric polycarboxylate as is this application.

SUMMARY OF THE INVENTION

In accordance with this invention a laundry detergent composition is provided wherein the solids content comprises an active surfactant, at least about 70 wt. % of a water-soluble alkaline carbonate, up to about 12 wt. %, of elemental magnesium in the form of a water soluble salt, and about 0.05 to 5 wt. % of a polymeric polycarboxylate, based on the total weight of solids in the composition. The term "polymeric polycarboxylate" includes homopolymers of monoethylenically unsaturated carboxylic acids and copolymers of such acids as hereinafter defined.

Incorporation of magnesium ions in the foregoing laundry detergent composition containing carbonate ions is intended to minimize negative interactions that will occur between the precipitation of calcium carbonate and the surfaces of the fabric being cleaned. For example, the composition is capable of providing excellent cleaning and whitening of fabrics while avoiding the problem of eutrophication which occurs when a substantial amount of a phosphorous containing builder such as STPP is present in the composition, and while minimizing the problem of fabric encrustation often present when the composition contains a large amount of carbonate builder.

The reduction in the amount of fabric encrustation when using the laundry detergent composition of this invention is apparently partly due to an effect of magnesium ions at certain concentrations in inhibiting the precipitation of calcium carbonate on the substrate being cleaned, i.e., fabric surfaces, for a limited period of time, with an enhancement of this effect due to the presence of the polymeric polycarboxylate. This is a surprising effect since magnesium is commonly considered to be equal to calcium as a hardness ingredient of water. Furthermore the enhancement in the reduction of encrustation caused by the combination of polymeric polycarboxylate with magnesium is also surprising since such polycarboxylate is conventionally used in detergent compositions to prevent encrustation by calcium and magnesium hardness.

DETAILED DESCRIPTION OF THE INVENTION

The water-soluble alkaline carbonate may be, for example, an alkali metal carbonate, bicarbonate or sesquicarbonate, preferably sodium or potassium carbonate, bicarbonate or sesquicarbonate, and most preferably sodium carbonate. A combination of more than one of such compounds may be used, e.g., sodium carbonate and sodium bicarbonate. The total water-soluble alkaline carbonate may be present in an amount, for example, of about 70 to 90 wt. %, preferably about 75 to 85 wt. %. If a combination of alkali metal carbonate and bicarbonate is used as the water-soluble carbonate, then the alkali metal carbonate, e.g., sodium carbonate, is preferably used in an amount of about 75 to 80 wt. % and the alkali metal bicarbonate, e.g., sodium bicarbonate, in an amount of about 0.1 to 15 wt. %.

Water soluble magnesium salts which may be used in preparing the detergent compositions of this invention are, for example, magnesium sulfate, magnesium chloride, magnesium nitrate, magnesium acetate, and dibasic magnesium citrate. Sufficient magnesium salt is added to the composition such that elemental magnesium is present in an amount, for example, of up to about 12 wt. % based on the total solids. In general, the wash water before the addition of cleaning composition contains a calcium hardness of for example, about 10 to 350 ppm of calcium hardness expressed as $CaCO_3$ and a Ca/Mg molar ratio of, for example, about 5/1 to 2/1 may be present, in which case the elemental magnesium in the detergent composition should be, for example, about 0.1 to 12 wt. %, preferably about 1 to 5 wt. % based on the weight of total solids in the composition. An amount of magnesium within the foregoing ranges may add, for example about 7 to 800 ppm, preferably about 65 to 340 ppm, of magnesium expressed as $CaCO_3$ to the wash water, based on the weight of the wash water, so that the final wash liquor contains after the addition of detergent composition, for example, about 15 to 1160 ppm, preferably about 75 to 690 ppm of magnesium expressed as $CaCO_3$. This has the effect of decreasing the Ca/Mg molar ratio in the wash liquor by a number of units in the range of about 4/1 to 1/4 units, preferably about 1/1 to 1/2 units, so that the Ca/Mg molar ratio in the wash liquor after the addition of the detergent composition is in the range, for example, of about 4/1 to about 1/4, preferably about 1/1 to about 1/2, at which the beneficial effect of magnesium in reducing encrustation is most evident. If the calcium hardness and magnesium content of the wash water before the addition of detergent composition is known to be substantially outside the stated ranges, the broad and preferred ranges of the amount of elemental magnesium in the detergent composition may be adjusted so that the amount of calcium and magnesium in the wash liquor falls within the foregoing ranges after the addition of detergent composition. The foregoing ranges of amount of magnesium in the detergent composition and the calcium and magnesium content of the wash liquor before and after the addition of detergent composition assume normal and accepted use of a detergent wherein the wash liquor contains about 0.1 to 1 wt. % of detergent solids during the washing operation. The term "expressed as $CaCO_3$" as applied to amounts of calcium or magnesium in this paragraph and hereinafter, means the weight in parts per million of the number of moles of $CaCO_3$ equal to the number of moles of calcium or magnesium being characterized.

The active surfactant component may be, for example, one or more of many suitable synthetic detergent active compounds which are commercially available and described in the literature, e.g., in "Surface Active Agents and Detergents", Volumes 1 and 2 by Schwartz, Perry and Berch. Several detergents and active surfactants are also described in, for example, U.S. Pat. Nos. 3,957,695; 3,865,754; 3,932,316 and 4,009,114. In general, the composition may include a synthetic anionic, nonionic, amphoteric or zwitterionic detergent active compound, or mixtures of two or more of such compounds.

More preferably, the laundry detergent compositions of this invention contain at least one anionic or nonionic surfactant, and, most preferably, a mixture of the two types of surfactant.

The contemplated water soluble anionic detergent surfactants are the alkali metal (such as sodium and potassium) salts of the higher linear alkyl benzene sulfonates and the alkali metal salts of sulfated ethoxylated and unethoxylated fatty alcohols, and ethoxylated alkyl phenols. The particular salt will be suitably selected depending upon the particular formulation and the proportions therein.

The sodium alkybenzenesulfonate surfactant (LAS), if used in the composition of the present invention, preferably has a straight chain alkyl radical of average length of about 11 to 13 carbon atoms.

Specific sulfated surfactants which can be used in the compositions of the present invention include sulfated ethoxylated and unethoxylated fatty alcohols, preferably linear primary or secondary monohydric alcohols with $C_{10}$–$C_{18}$, preferably $C_{12}$–$C_{16}$, alkyl groups and, if ethoxylated, on average about 1–15, preferably 3–12 moles of ethylene oxide (EO) per mole of alcohol, and sulfated ethoxylated alkylphenols with $C_{12}$–$C_{16}$ alkyl groups, preferably $C_8$–$C_9$ alkyl groups, and on average from 4–12 moles of EO per mole of alkyl phenol.

The preferred class of anionic surfactants are the sulfated ethoxylated linear alcohols, such as the $C_{12}$–$C_{16}$ alcohols ethoxylated with an average of from about 1 to about 12 moles of ethylene oxide per mole of alcohol. A most preferred sulfated ethoxylated detergent is made by sulfating a $C_{12}$–$C_{15}$ alcohol ethoxylated with 3 moles of ethylene oxide per mole of alcohol.

Specific nonionic surfactants which can be used in the compositions of the present invention include ethoxylated fatty alcohols, preferably linear primary or secondary monohydric alcohols with $C_{10}$–$C_{18}$, preferably $C_{12}$–$C_{16}$, alkyl groups and on average about 1–15, preferably 3–12 moles of ethylene oxide (EO) per mole of alcohol, and ethoxylated alkylphenols with $C_8$–$C_{16}$ alkyl groups, preferably $C_8$–$C_9$ alkyl groups, and on average about 4–12 moles of EO per mole of alkyl phenol.

The preferred class of nonionic surfactants are the ethoxylated linear alcohols, such as the $C_{12}$–$C_{16}$ alcohols ethoxylated with an average of from about 1 to about 12 moles of ethylene oxide per mole of alcohol. A most preferred nonionic detergent is a $C_{12}$–$C_{15}$ alcohol ethoxylated with 3 moles of ethylene oxide per mole of alcohol.

Mixtures of the foregoing synthetic detergent type of surfactants, e.g., of anionic and nonionic, or of different specific anionic or nonionic surfactants, may be used to modify the detergency, sudsing characteristics, and other properties of the composition. For example, a mixture of different fatty alcohols of 12 to 15 carbon atoms may be ethoxylated, directly sulfated, or sulfated after ethoxylation, a fatty alcohol may be partially ethoxylated and sulfated, or an ethoxylated fatty acid may be partially sulfated to yield a mixture of different anionic and nonionic surfactants or different specific anionic or nonionic surfactants.

The total active surfactant in the composition may be in the range, for example, of about 5 to 15 wt. % preferably about 8 to 12 wt. % based on the weight of solids in the composition. If, as preferred, the active surfactant consists of a combination of anionic and nonionic surfactants, then the anionic surfactant is present in the range, for example, of about 4 to 14 wt. %, preferably about 5 to 10 wt. %, and the nonionic surfactant is present in the range, for example, of about 2 to 8 wt. %, preferably about 3 to 5 wt. %, all based on the weight of total solids.

The polymeric polycarboxylate may be, for example, a homopolymer or copolymer (composed of two or more co-monomers) of an alpha, beta-ethylenically unsaturated acid monomer such as acrylic acid, methacrylic acid, a diacid such as maleic acid, itaconic acid, fumaric acid, mesoconic acid, citraconic acid and the like, a monoester of a diacid with an alkanol, e.g., having 1–8 carbon atoms, and mixtures thereof. When the polymeric polycarboxylate is a copolymer, it may be a copolymer of more than one of the foregoing unsaturated acid monomers, e.g., acrylic acid and maleic acid, or a copolymer of at least one of such unsaturated acid monomers with at least one non-carboxylic alpha, beta-ethylenically unsaturated monomer which may be either relatively non-polar such as styrene or an olefinic monomer, such as ethylene, propylene or butene-1, or which has a polar functional group such as vinyl acetate, vinyl chloride, vinyl alcohol, alkyl acrylates, vinyl pyridine, vinyl pyrrolidone, or an amide of one of the delineated unsaturated acid monomers, such as acrylamide or methacrylamide. Certain of the foregoing copolymers may be prepared by aftertreating a homopolymer or a different copolymer, e.g., copolymers of acrylic acid and acrylamide by partially hydrolyzing a polyacrylamide.

Copolymers of at least one unsaturated carboxylic acid monomer with at least one non-carboxylic comonomer should contain at least about 50 mol % of polymerized carboxylic acid monomer.

The polymeric polycarboxylate should have a number average molecular weight of, for example about 1000 to 10,000, preferably about 2000 to 5000. To ensure substantial water solubility, the polymeric polycarboxylate is completely or partially neutralized, e.g., with alkali metal ions, preferably sodium ions, or with magnesium ions supplied by magnesium oxide or hydroxide which thus acts as the source of the added magnesium.

The polymeric polycarboxylate is present in the detergent composition in an amount, for example, of about 0.05 to 5 wt. % preferably about 0.1 to 2 wt. % based on the weight of the total solids.

In addition to its usual function as a soil antiredeposition agent, the polymeric polycarboxylate has the unexpected effect in this invention of enhancing the reduction of encrustation caused by the added magnesium. Thus, in the absence of polymeric polycarboxylate, the added magnesium of this invention has the effect of reducing fabric encrustation for wash cycle times of up to about 12 minutes when the total calcium plus magnesium hardness of the wash water is at least about 50 ppm expressed as $CaCO_3$; at wash cycle times appreciably above about 20 minutes, the addition of magnesium may increase encrustation. However, in the presence of a polymeric polycarboxylate, the addition of magnesium reduces encrustation at all practical wash cycle times and to a degree considerably greater than the added magnesium alone, or of the polymeric polycarboxylate alone.

The detergent composition of this invention is preferably in the form of a dry-appearing powder, in which case the weight percentages of the various components mentioned previously are approximately based on the weight of the total composition. However, such dry appearing powder generally contains water in an amount, for example, of about 1 to 12 wt. %, preferably about 2 to 10 wt. % based on the weight of the total composition. Alternatively, however, the detergent composition may be in the form of a liquid, e.g., a concentrated aqueous solution of the detergent components containing, for example, about 0.5 to 30 wt. % of detergent solids.

The laundry detergent compositions of this invention may also contain various adjuvants common to detergent formulations such as brighteners, enzymes, carboxymethylcellulose, perfumes, dyes and peroxide generating persalts.

The following examples further illustrate the invention. In the examples involving values of turbidity, a test for turbidity was used, the results of which correlate with the fabric encrustation caused by the employment of a carbonate built detergent composition, with lower turbidity indicating lower fabric encrustation. The test is carried out utilizing a calcium hardness solution containing a predetermined amount of calcium chloride dihydrate dissolved in deionized water, and a detergent solution in deionized water of a predetermined amount of carbonate built detergent composition to be tested containing either no magnesium as a control or a predetermined amount of a soluble magnesium salt such as magnesium sulfate or magnesium chloride. The concentrations of calcium chloride dihydrate in the calcium hardness solution and of the components of the detergent composition are controlled so that when predetermined amounts of the two solutions are mixed together with a predetermined additional amount of ionized water, an overall solution containing about 0.162 wt. % of detergent composition, a desired calcium hardness expressed as ppm of calcium carbonate, and a desired amount of magnesium as ppm of $CaCO_3$ and level of Ca/Mg molar ratio are obtained. The predetermined amounts of the two solutions and the deionized water to be added, are preheated to 35° C. and combined with stirring simultaneously with the starting of a timer. Stirring of the combined solution is continued and the turbidity of the solution is measured with a Hach Turbidimeter in National Turbidity Units (NTU's) at certain set time intervals, e.g., 5, 10, 15 and 20 min.

Example 1 and Comparative Examples A, B and C

In each of these examples, turbidity determinations were carried out using solutions of a base detergent composition comprising 80 parts of sodium carbonate, 0.5 parts of sodium bicarbonate, an active surfactant consisting of 6.0 parts of the sodium salt of a sulfated $C_{12}$–$C_{15}$ alcohol (anionic surfactant) and 3.2 parts of a $C_{12}$–$C_{15}$ alcohol ethoxylated with 3 moles of ethylene oxide per mole of alcohol (nonionic surfactant) and a calcium hardness in the combined solution of 100 ppm expressed as $CaCO_3$. However, the examples differed in that no magnesium was present in the combined solution in Comparative Examples A and C, 100 ppm of magnesium expressed as $CaCO_3$ was present in Comparative Example B and Example 1 such that the Ca/Mg molar ratio was 1/1, no polymeric polycarboxylate ("polymer") was present in Comparative Examples A and B and 1.5 wt. % of a polymer based on the weight of the detergent composition was present in Comparative Example C and Example 1, such polymer being a terpolymer of about 49.5 wt. % acrylic acid, about 49.5 wt. % maleic acid, and about 1 wt. % of acrylamide and having a number average molecular weight of about 3000. The polymer was completely neutralized on contact with the sodium carbonate of the detergent formulation. The turbidities after 10 and 20 min. are shown in Table I.

TABLE I

| Example | Polymer wt. % | Mg, ppm as $CACO_3$ | Turbidity (NTU) 10 min. | Turbidity (NTU) 20 min. |
|---|---|---|---|---|
| A | 0 | 0 | 113 | 118 |
| B | 0 | 100 | 9 | 77 |
| C | 1.5 | 0 | 30 | 31 |
| 1 | 1.5 | 100 | 0.4 | 0.5 |

The results of Table I show that not only do magnesium and the polymeric polycarboxylate each separately reduce turbidity substantially after 10 and 20 min., but that the presence of both magnesium and polymeric polycarboxylate reduce the turbidity still further to a degree which could not have been predicted from the separate effects of the magnesium and polymer, i.e., the two additives together result in a synergistic effect.

Example 2 and Comparative Example D

In Comparative Example D, the procedure of Comparative Example B was followed utilizing 150 ppm of calcium and varying amounts of magnesium. The results are shown in Table II.

TABLE II

| Mg present, ppm as $CaCO_3$ | Ca/Mg molar ratio | Turbidity (NTU) 10 min | Turbidity (NTU) 20 min |
|---|---|---|---|
| 0 | — | 192 | — |
| 50 | 3/1 | 157 | 176 |
| 75 | 2/1 | 159 | 172 |
| 100 | 1.5/1 | 128 | 170 |
| 125 | 1.2/1 | 26 | 138 |
| 150 | 1/1 | 31 | 69 |
| 175 | 1.5/1.75 | 20 | 109 |
| 200 | 1.5/2 | 86 | 177 |

The results of Table II show that at 150 ppm of Ca, the turbidity is decreased by the presence of 50 to 200 ppm of Mg corresponding to a Ca/Mg ratio of from above 3/1 to 1.5/2 after 10 min. of contact between the calcium hardness solution and the detergent solution, while after 20 min. of contact, the turbidity is decreased at a Ca/Mg ratio of from 3/1 to 1.5/1.75.

In Example 2, the procedure of Comparative Example D was followed except that 1.5 wt. % of the polymer utilized in Example 1 was present in each combined solution. The results are shown in Table III.

TABLE III

| Mg, ppm (as CaCO3) | Ca/Mg, Molar Ratio | Turbidity (NTU) 10 min. | Turbidity (NTU) 20 min. |
|---|---|---|---|
| 0 | — | 182 | 193 |
| 50 | 3/1 | 193 | 205 |
| 75 | 2/1 | 93 | 117 |
| 100 | 1.5/1 | 1 | 22 |
| 125 | 1.2/1 | 4 | 3 |
| 150 | 1.0/1 | 9 | 8 |
| 175 | 1/1.2 | 14 | 15 |
| 200 | 1/1.3 | 20 | 24 |

The results of Table III as compared with those of Table II indicate that the presence of both magnesium and polymer exerts a strong synergistic effect on the reduction of turbidity caused by the interaction of calcium hardness and a carbonate built detergent composition at 10 and 20 min. contact time.

Example 3 and Comparative Example E

These examples show the comparative results of encrustation tests of two detergent formulations. In Comparative Example E the formulation consisted of the base detergent composition described in Comparative Example A plus 1.35 wt. % of Rohm & Haas 445 polymer, which is a polyacrylic acid having a number average molecular weight of about 4500. The polymer becomes completely neutralized on contact with the sodium carbonate of the formulation. In Example 3 the formulation consisted of the same base detergent composition and polymer as Comparative Example E plus 7 wt. % of $MgSO_4$. The two detergent compositions were tested for fabric encrustation by repeated washing of cotton fabric at 35° C. In carrying out the test, four 25.4 cm.×25.4 cm., 100% black cotton fabric swatches along with 0.907 kg. of ballast are washed for 12 min. with 113.4g of the detergent composition being tested such that the wash liquor contained about 0.162 wt. % of detergent. After washing is completed, 2.00–4.00 g of the calcium carbonate encrusted fabrics are extracted in 100 ml. of 0.2 N hydrochloric acid for 30 min. and a 2.0–4.0 ml. aliquot is analyzed for hardness by the EDTA titration method. Encrustation is expressed as mg. calcium carbonate per gram of fabric.

In Comparative Example E wherein the detergent formulation contained 1.35 wt. % of polymer and no magnesium, the encrustation was 53 mg of $CaCO_3$ per gram of fabric, while in Example 3 wherein the formulation contained 7 wt. % of $MgSO_4$ and 1.35 wt. % of polymer, the fabric encrustation was 15 mg $CaCO_3$ per gram of fabric. The latter value indicates a synergistic effect of magnesium and polymer used together since the difference between such value and that of 103 obtained when neither magnesium nor polymer was present in the formulation (Comparative Example C of Application Ser. No. 08/136,397, filed , Oct. 13, 1993) is greater than would be predicted from the value of 99 obtained when magnesium but no polymer was present in the formulation (Example 7 of Ser. No. 08/136,397), and the value of 53 obtained when polymer but no magnesium was present (Comparative Example E). The foregoing values of encrustation were obtained after five machine cycles of use.

Examples 4 to 7 and Comparative Example F

These examples illustrate that the benefit in reduced turbidity of including both magnesium and a polymeric polycarboxylate in a carbonate built detergent can be obtained by using a basic magnesium compound to neutralize the acid as well as by separate addition of a magnesium compound and polymer.

The procedure of Example 3 was followed except that the detergent formulation included 1.35 wt. % of the Rohm & Haas 445 polymer as described in Example 3, neutralized as specified hereinafter. The combined solution measured for turbidity contained, exclusive of any magnesium used to neutralize the polymer or added as equivalent to the neutralized base, 150 ppm of calcium and 75 ppm of magnesium each expressed as $CaCO_3$ (Ca/Mg molar ratio=2/1) which is typical of the natural hardness of water.

In Comparation Example F, the polymer was neutralized with sodium carbonate.

In Example 4, the polymer was neutralized neat with MgO.

In Example 5, the polymer was diluted with water and neutralized with MgO.

In Example 6, the polymer was neutralized with NaOH followed by "ion exchange" with a stoichiometric amount of $MgSO_4$.

In Example 7, the polymer was neutralized with sodium carbonate and an equivalent amount of $MgSO_4$ added to the system. The turbidities of the sample after 5, 10 and 15 minutes are shown in Table IV.

TABLE IV

| Example | Turbidity (NTU) 5 min. | 10 min. | 15 min. |
|---|---|---|---|
| F | 3 | 40 | 85 |
| 4 | 4 | 14 | 48 |
| 5 | 3 | 5 | 58 |
| 6 | 1 | 2 | 55 |
| 7 | 1 | 1 | 27 |

The results of Table IV indicate that at a contact time between detergent composition and wash water above a point between five and ten minutes, the turbidity is reduced by the presence of magnesium ions whether added for the neutralization of the polymer (Examples 4, 5 and 6) or separately (Example 7). The reduction in turbidity at 10 and 15 minutes in Examples 4 to 7 is obtained despite the fact that the addition of magnesium resulted in a relatively slight increase of magnesium in the combined solution, i.e., only 15 ppm expressed as $CaCO_3$, for a reduction of the Ca/Mg molar ratio of from 150/75 (2/1) to 150/90.

Examples 8 to 17 and Comparative Examples G and H

These examples illustrate the effect of carrying out 5 cycle encrustation tests using varying amounts of Rohm and Haas 445 polymer and magnesium sulfate in the detergent composition at a constant hardness of wash water.

The tests were carried out using the procedure described in Example 3 and Comparative Example E, under the following constant conditions: total wash water hardness (Ca+Mg, Ca/Mg molar ratio of 2/1)=250 ppm; wash temperature=35° C.; and wash cycle=12 min. The content of Rohm and Haas 445 polymer ("polymer") and magnesium sulfate ("$MgSO_4$") as weight percent of the detergent composition and fabric encrustation as mg. of calcium carbonate per gram of fabric obtained in each example are shown in Table V.

TABLE V

| Example | Polymer, wt. % | $MgSO_4$, wt. % | Fabric Encrustation, mg $CaCO_3$/g fabric |
|---|---|---|---|
| G | 0 | 0 | 97 |
| H | 1.00 | 0 | 85 |
| 8 | 0 | 7 | 99 |
| 9 | 1.00 | 7 | 28 |
| 10 | 1.00 | 3.5 | 73 |
| 11 | 1.00 | 2.0 | 89 |
| 12 | 1.35 | 7 | 26 |
| 13 | 1.35 | 5 | 43 |
| 14 | 1.35 | 3 | 57 |
| 15 | 0.92 | 7 | 23 |
| 16 | 0.62 | 7 | 20 |
| 17 | 0.31 | 7 | 32 |

The results of Table V indicate that at a wash cycle time of 12 min. and a polymer content of 1.00 wt. % the synergistic effect of magnesium and polymer on fabric encrustation is most pronounced when the $MgSO_4$ content is at least about 3.5 wt. % and increases as the $MgSO_4$ content is increased. However, at a $MgSO_4$ content of 7 wt. %, a pronounced synergistic effect can be obtained with a relatively low polymer content, e.g.

0.3 wt. % which is comparable to that obtained at a polymer content of 1.35 wt. %.

We claim:

1. A laundry detergent composition wherein the solids comprise about 5 to 15 wt. % of an active surfactant, at least about 70 wt. % of a water-soluble alkaline carbonate, bicarbonate or sesquicarbonate, or combination thereof, about 0.1 to about 12 wt. % of magnesium in the form of a water soluble salt, selected from the group consisting of magnesium sulfate, magnesium chloride, magnesium acetate, magnesium citrate, and magnesium nitrate and about 0.15 to 5 wt. % of a polymeric polycarboxylate, based on the total weight of solids in the composition.

2. The composition of claim 1 wherein said solids comprise an alkali metal carbonate.

3. The composition of claim 2 wherein said alkali metal carbonate is sodium carbonate.

4. The composition of claim 3 wherein said solids comprise about 75 to 80 wt. % of sodium carbonate and about 0.1 to 15 wt. % of sodium bicarbonate based on the total weight of solids.

5. The composition of claim 5 wherein said magnesium comprises about 1 to 5 wt. % of the total solids.

6. The composition of claim 1 wherein said magnesium salt is magnesium sulfate.

7. The composition of claim 1 wherein said magnesium salt is magnesium chloride.

8. The composition of claim 1 wherein said active surfactant comprises an anionic surfactant and a nonionic surfactant.

9. The composition of claim 8 wherein said anionic surfactant is an alkali metal salt of sulfated linear $C_{12}$–$C_{16}$ alcohols ethoxylated with an average of 1 to 12 moles of ethylene oxide per mole of alcohol and is present in an amount of about 4 to 14 wt. % and said nonionic surfactant consists of $C_{12}$–$C_{16}$ linear alcohols ethoxylated with an average of 1 to 12 moles of ethylene oxide per mole of alcohol and is present in an amount of about 2 to 8 wt. % based on the weight of total solids.

10. The composition of claim 1 wherein said polymeric polycarboxylate is an acrylic acid polymer.

11. The composition of claim 1 in the form of a dry-appearing powder containing about 1 to 12 wt. % of water.

12. A process comprising washing a fabric in an aqueous wash liquor containing the composition of claim 1.

13. The process of claim 12 wherein the wash cycle is for a period of greater than about 12 minutes.

14. The process of claim 2 wherein the wash water before the addition of cleaning composition has a calcium hardness of about 10 to 350 ppm expressed as $CaCO_3$ and a Ca/Mg molar ratio of about 5/1 to 2/1, and the addition of said composition adds to the wash liquor about 7 to 800 ppm of magnesium expressed as the weight of the number of moles of $CaCO_3$ equal to the number of moles of added magnesium, and reduces the Ca/Mg molar ratio in the wash liquor to a value in the range of about 4/1 to 1/4.

15. The composition of claim 1 wherein said magnesium salt is magnesium nitrate.

16. The composition of claim 1 wherein said magnesium salt is magnesium acetate.

17. The composition of claim 1 wherein said magnesium salt is dibasic magnesium citrate.

* * * * *